United States Patent [19]

Keeler

[11] Patent Number: 4,996,863

[45] Date of Patent: Mar. 5, 1991

[54] RADIALLY CONVERGENT HOT FORGING APPARATUS AND METHOD

[75] Inventor: Philip S. Keeler, Santa Ana, Calif.

[73] Assignee: Aluminum Precision Products, Inc., Santa Ana, Calif.

[21] Appl. No.: 414,003

[22] Filed: Sep. 28, 1989

[51] Int. Cl.[5] ..... B21J 13/02

[52] U.S. Cl. ..... 72/342.8; 72/353.2

[58] Field of Search ..... 72/353, 402, 353.2, 72/354.2, 342.8

[56] References Cited

U.S. PATENT DOCUMENTS

| | | | |
|---|---|---|---|
| 2,114,596 | 4/1938 | Franghia | 72/353 |
| 2,382,359 | 8/1945 | Weightman | 72/402 |
| 3,103,833 | 9/1963 | Lejdegard | 72/402 |
| 3,349,596 | 10/1967 | Pavlovec | 72/402 |
| 3,406,555 | 10/1968 | Fuchs, Jr. | 72/353 |
| 3,456,479 | 7/1969 | Matveev et al. | 72/402 |

FOREIGN PATENT DOCUMENTS

| | | | |
|---|---|---|---|
| 199036 | 8/1958 | Austria | 72/402 |
| 565766 | 7/1977 | U.S.S.R. | 72/402 |
| 1382573 | 3/1988 | U.S.S.R. | 72/402 |

*Primary Examiner*—Lowell A. Larson
*Attorney, Agent, or Firm*—Allan R. Fowler

[57] ABSTRACT

Disclosed is a method and apparatus for hot forging an elongated cylindrical hot billet formed of lightweight metal alloy or metal matrix composite material into an integral high strength structural member having at least two extensive walls projecting outwardly in different directions from the billet axis, with principal metal grain structure running approximately parallel to the outward extent of the walls. The hot forging is accomplished by bringing a plurality of radially convergent hot die segments from a full open release position to an intermediate position where they first convergently engage the hot billet, and gradually further converging the die segments to a closed position to forge the billet by engaging them with a pyramidal or conical frustum cavity formed in a press member, which cavity conforms to the external configuration of the die segments in the closed position.

6 Claims, 5 Drawing Sheets

FIG. 3.
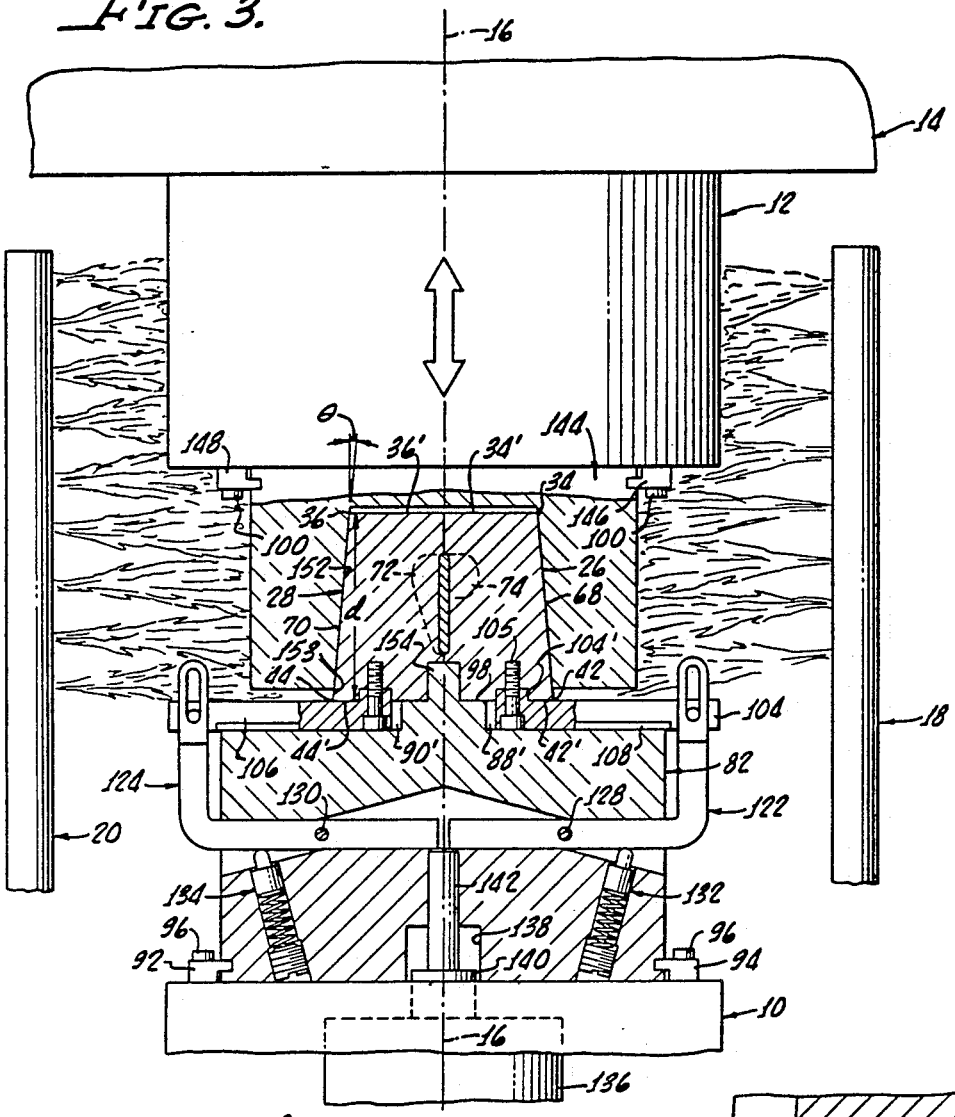
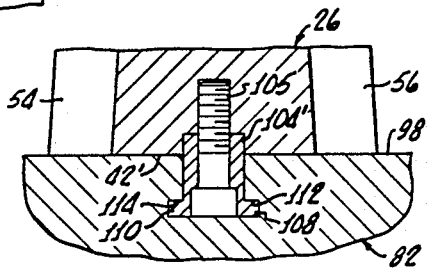
FIG. 6.
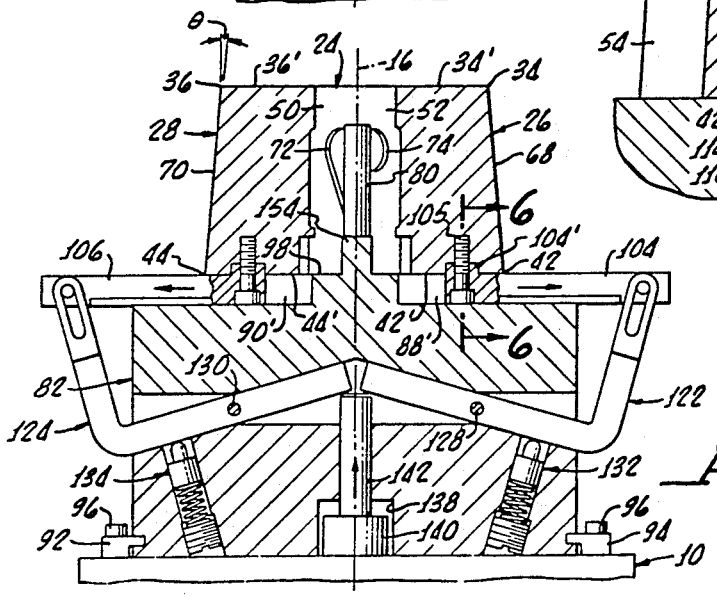
FIG. 2.

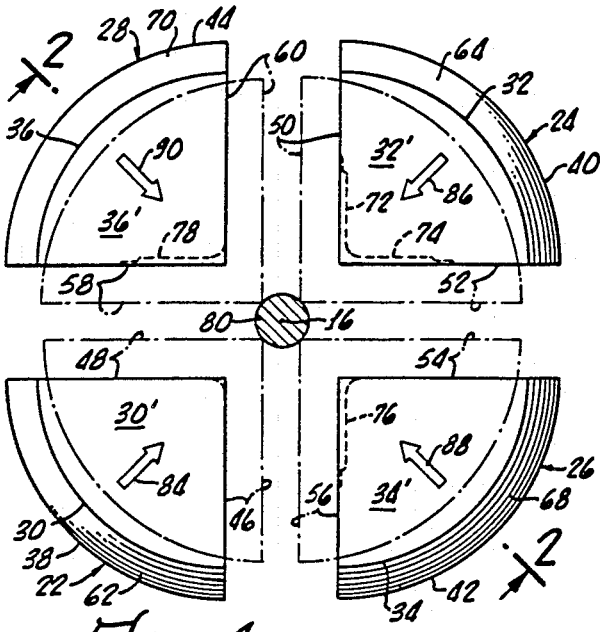
FIG. 4.
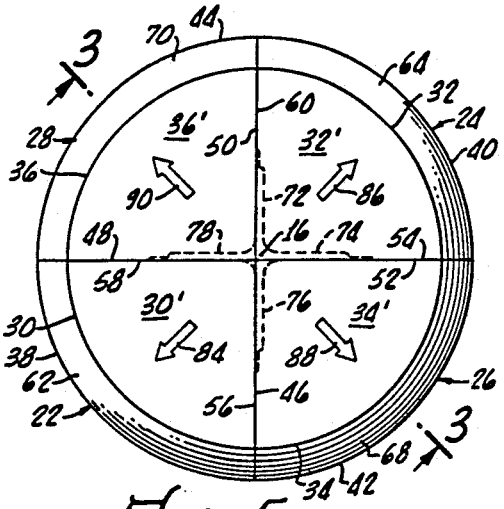
FIG. 5.
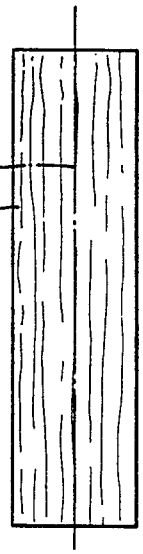
FIG. 7.
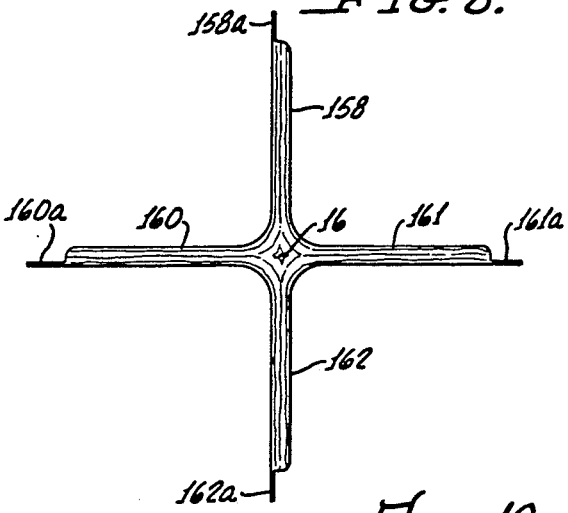
FIG. 8.
FIG. 9.
(PRIOR ART)
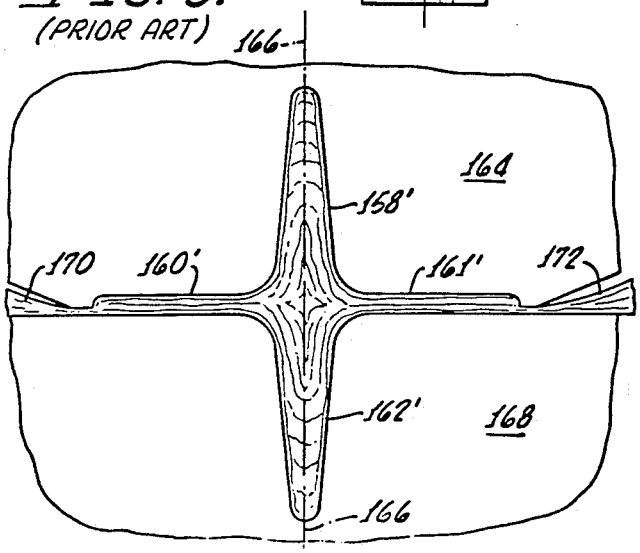
FIG. 10.
(PRIOR ART)
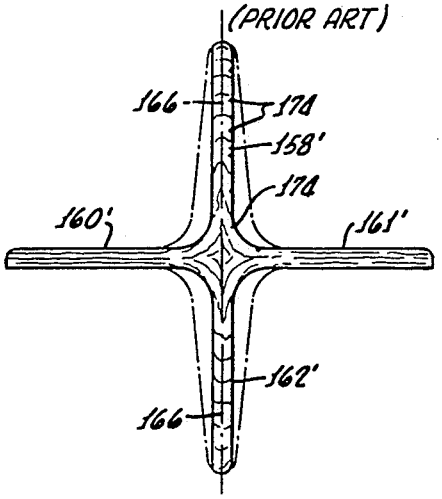

FIG. 17.
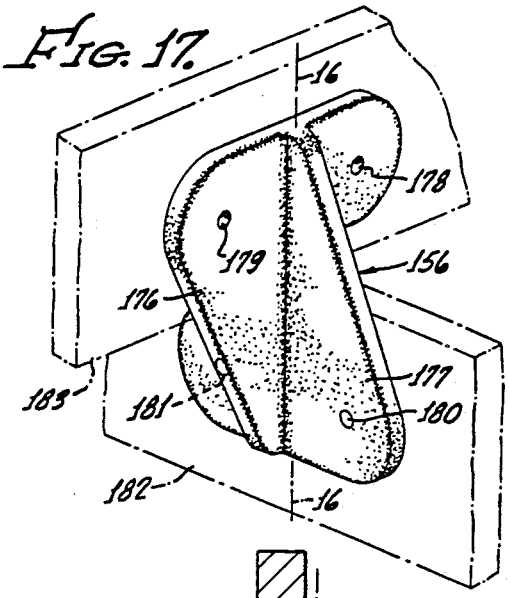
FIG. 18.
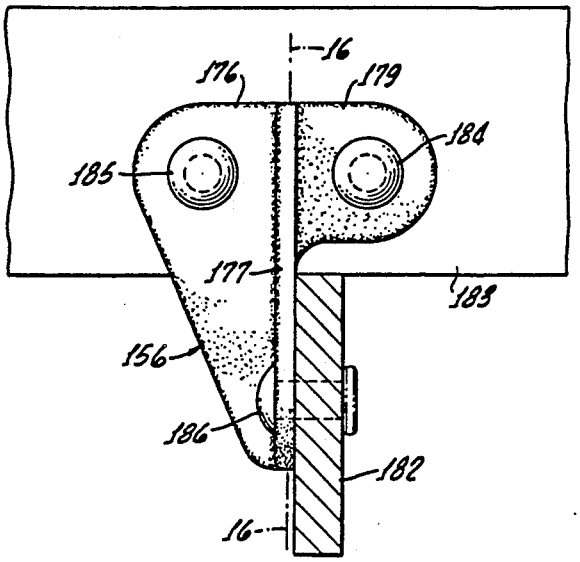
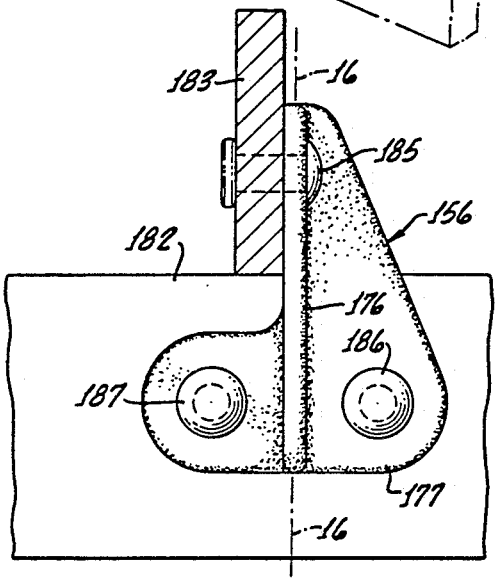
FIG. 19.
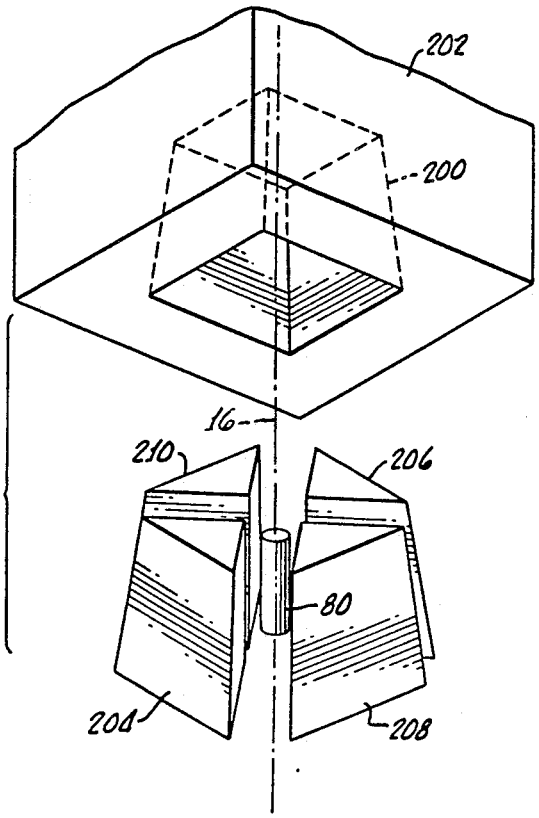
FIG. 20.

RADIALLY CONVERGENT HOT FORGING APPARATUS AND METHOD

This invention relates to close tolerance hot forging apparatus, methods and resulting forged products, and has particular reference to an innovative convergent radial forging apparatus, method, and a product thereof, in which an elongated preheated billet of lightweight metal alloy or lightweight metal matrix composite material is hot forged into an integral high strength structural member having at least two walls of substantial extent respectively extending along and respectively outward in different directions from the axis of the elongated billet which is disposed approximately concident with a central forging axis, respecting which the radial convergent forging occurs.

BACKGROUND OF THE INVENTION

In order to preserve the strength, durability and integrity of structural members which perform critical structural tasks, it is recognized as desireable, where possible, to forge each such structural member essentially into its final configuration, with a view toward creating and preserving the forged metal grain structure pattern, properly for such strength, integrity and durability. Many such structural members, however, require elongated configurations which are such that this is not practical. Such configurations, for example, are, overall, cruciform, channel or T-shaped in cross section while varying in shape longitudinally. They must fit closely within confined spaces formed by surrounding structures and consequently must be free from any substantial shape or size deviation such as substantial draft. Draft, a tapering thickness deviation, is a normal consequence of conventional two-die forging operations, required to release such parts from die cavities. A typical such structural member has at least two approximately flat walls of substantial extent respectively lying approximately in two planes disposed at an angle to each other, and the conventional initial forging leaves at least one of these walls oversized with very substantial draft, requires an oversize billet to fully fill the die cavities in the initial forging process itself, incurring a significant waste of material in excess flashing, and thereafter requires substantial machining operations to conform the forged structure to the required final configuration. These machining operations are not only an expensive extra step, but also tend to seriously interrupt the metal grain structure pattern achieved by the forging process, and leave minute score gouges in the most vulnerable directions and areas of such mechanical structural members, thus unfortunately promoting premature failure of the members.

This problem is particularly acute for lightweight metallic structural members employed in the aircraft industry where large numbers of such structural members are used as splice fittings to provide attachment links joining adjacent structural frame members of the aircraft.

In the aircraft industry, these structural linking members are variously referred to as splice fittings, clips, stringer clips or cleats. They are used, for example, to attach the ribs of aircraft wings to the stringers of the wings usually by rivoting the walls of the splice fitting respectively to such adjacent structural air-frame members, one of which typically passes above or below the other and at various angles. Regardless of external appearance, the structural integrity of the conventional aircraft depends upon the integrity of such splice fittings. Much of the stress on the frame of the aircraft is in fact transmitted to and through such splice fittings; hence, they perform a critical structural function, essential to safety.

It is the principal object of the present invention to provide a radial hot forging apparatus and method in which high strength structural members having extensive walls may be forged, substantially in finished form in a single operation from an elongated billet of lightweight metal alloy or lightweight metal matrix composite material, without resort to subsequent substantial machining to finish the structure to dimensional tolerances, thereby to preserve the metal grain pattern established by the metal forging process, and running approximately parallel to the outward extent of the walls from the billet axis.

Another object of the invention is to radially forge such structural member by gradually converging together a plurality of at least three pre-heated forging die segments along different approximately radial paths convergent upon a central forging axis to hot forge an elongated metallic billet centered on such axis into said structural member, efficiently and effectively.

A further object of the invention is to achieve said forged structural member, in the form of a splice fitting of lightweight metal alloy or lightweight metal matrix composite material, by the forging process of the invention, wherein said two approximately flat walls thereof, in their forged configuration are of about equal and substantially of uniform thickness throughout almost their entire extent, and have principal metal grain structure running approximately parallel to the extent of said walls, as opposed to transversely thereto along the thickness of said walls, with no substantial machining of said walls incurred to achieve such configuration.

So far as is known the radial forging apparatus and method as herein presented is rovel and unparalleled in the metal forging industry, and in that regard the resulting forged splice fitting for aircraft is unique, as is the radial forging apparatus and process.

Conventional forging apparatus and methods are described in *Forging Handbook*, edited by T. G. Byrer, sanctioned by the Forging Industries Association and the American Society for Metals, Library of Congress Catalog Number 85-071789, (1985).

There are prior patent references to the use of wedges for split ring forging dies which accommodate a punch die being axially interposed by a forging press to axially forge a billet into the cavity together defined by the two mating dies comprising the split ring. However, such split ring dies are merely locked together by the wedges and the forging forces are applied by the forging press to the axial punch die. (See, for example, Gardener, et. al., U.S. Pat. No. 4,466,266, and Delio, et. al., U.S. Pat. No. 4,559,804). Of course, the split ring dies are used so that they can be taken apart to remove the forged part after the wedge locking mechanism has been disengaged. Also, a pair of clamps moved together by wedges have been used to clamp onto a tube in order to hold the tube for subsequent longitudinal movement of the clamps to upset a portion of the tube wall to form or crimp a flange thereon in a cavity formed by the clamps. (See, for example, Redman, U.S. Pat. No. 4,757,703). So far as understood, these prior patent disclosures are typical of the state of the art in regard to the employment of wedges, and do not address or offer any solution to the metal forging challenges to which the present invention is directed.

SUMMARY OF THE INVENTION

The apparatus of the present invention represents an improvement in metal forging apparatus for receiving an elongated metallic billet having a longitudinal axis with principal metal grain structure running approximately parallel to said longitudinal axis, and hot forging said elongated billet into an integral high strength structural member having at least two walls, said walls being of substantial extent and extending along and respectively outward in different directions from said longitudinal billet axis, each wall having a substantial area and an average thickness, and extending outwardly from said longitudinal billet axis for a distance many times said average thickness.

In accordance with the present invention, a plurality of at least three mating solid forging die segments are provided. The die segments have tops, bases, and extensive proximal and exposed exterior wall surfaces which intersect and extend between said tops and bases, with die cavities formed in proximal surfaces of at least two of said forging die segments. The die segments are shaped to radially converge together into a closed position about a central forging axis while together encompassing 360° about said central forging axis for a substantial length of said central forging axis, in which closed position substantial portions of said proximal surfaces are in abuttment, with proximal surfaces of circumferentially adjacent die segments being in mating engagement, and the die segment cavities in combination with other portions of the proximal surfaces of said die segments volumetrically define the structural member to be forged.

The forging die segments are mounted about said central forging axis for restricted movement toward and away from such central forging axis each along a different one of at least three different approximately radial paths, said paths extending generally radially from said central forging axis in a common plane normal to said central forging axis, and said movement being between the closed position and an open position in which the die segments are separated and disposed at spaced apart radial positions about the central forging axis. Means are provided for moving said forging die segments to the open position to enable removal of any previously forged structural member, and the introduction and disposition of the elongated pre-heated billet with its longitudinal axis approximately coincident with the central forging axis in readiness to forge the structural member to be forged.

Means are provided for closing the open position forging die segments to an intermediate position to initially engage the elongated billet disposed co-axial along the central forging axis. Means are provided for heating the die segments to the forging temperature of the billet material, and means are provided for moving the forging die segments from the intermediate to the closed position while applying forging forces to the die segments sufficient to forge the engaged billet into the structural member to be forged.

Moreover, the plurality of die segments in the closed position have an external configuration about that of the frustum of a convergent geometric solid symetrical about the central forging axis with the base of the frustum being defined collectively by the die segment bases, the top of the frustum being defined collectively by the tops of the die segments and the convergent body of the frustum being defined collectively by the exterior wall surfaces of the die segments. The means mounting the forging die segments for restricted movement along the radial paths includes a holder, and means mounting the holder to the base platen of a forging press in a position centered on the central forging axis. A press member mounted on the moveable platen of the forging press in a position centered on the central forging axis. The press member has an open cavity configured as the frustum of the same geometric solid, such cavity being disposed coaxial with the central forging axis and matching the frustum configuration of the plurality of forging die segments in the closed position, whereby the forging press may be actuated to force the open cavity of the press member onto the plurality of die segments in the intermediate position to move them to the closed position so as to forge the billet into said structural member to be forged. Preferably, the geometric solid is a right cone, but it may be a right pyramid.

The improved method of the present invention for hot forging the elongated billet into the defined structural member to be forged includes the steps of heating the billet to forging temperature, supporting the billet in a position with its longitudinal axis coincident with the central forging axis, the position being surrounded by the forging die segments, heating the forging die segments to the forging temperature of the billet material, converging the die segments simultaneously along different radial paths to the closed position so as to forge the billet into the structure to be forged with metal grain structure running approximately parallel to the outward extent of the walls, and moving the die segments along the radial paths to an open position for removal of the forged structural member.

The product of the invention is a structural member, in the form of a splice fitting for joining adjacent structural members of aircraft or the like, hot forged of lightweight metal alloy or lightweight metal matrix composite material in accordance with the method of the invention, wherein the approximately flat walls in this initial forged configuration are of substantially uniform thickness throughout approximately their entire extent, and have principal metal grain structure approximately parallel to the outward extent of the walls, as opposed to transversely thereto along the thickness of the walls, with no substantial subsequent machining incurred to achieve such configuration.

BRIEF DESCRIPTION OF THE DRAWINGS

The foregoing and other objects, features and advantages of the invention will be better understood from the following detailed description of a preferred embodiment thereof, made with reference to the accompanying drawings, in which:

FIG. 2 is an elevation, partly in section of the base platen, holder, billet, and forging die segments of FIG. 1 in assembled form in the open position, with the view being taken generally along line 2—2 of FIGS. 1 and 4;

FIG. 3 is a fragmentary elevation, partly in section of the forging press of FIG. 1 similar to FIG. 2 but showing the forging die segments and holder in the closed position as seen along line 3—3 of FIG. 5, with the press member fully engaged and further illustrating double acting rams respectively for the moveable platen and for the holder arms as well as showing, diagrammatically, gas fired burners for the hot forging operation;

FIG. 4 is a top view of the forging die segments and billet of FIGS. 1 thru 3 in the open position, with the intermediate position shown in phantom line;

FIG. 5 is a top view of the forging die segments and billet of FIGS. 1 thru 4 in the closed position;

FIG. 6 is an enlarged fragmentary elevation, partly in section taken along line 6—6 of FIG. 2 showing typical key ways as formed in side walls of a typical radial slot in the holder with mating arm keys, and the typical engagement of the base surface of a die segment with the supporting surface of the holder;

FIG. 7 is a diagrammatic sectional elevation of the elongated cylindrical billet of FIGS. 1—5, depicting diagrammatically the longitudinal (axial) metal grain structure thereof;

FIG. 8 is a diagrammatic sectionof a cruciform forged structural member resulting from application of the present invention, to the billet of FIG. 7, and showing diagramatically the resulting metal grain structure;

FIG. 9 is a diagramatic section of a cruciform structural member, forged by two dies according to the prior art, and showing diagramatically the resulting prior art metal grain structure;

FIG. 10 is a diagrammatic section of the cruciform forged structural member of FIG. 9, showing in phantom line the metal to be removed by machining to conform the forged structure to the required configuration illustrated in FIG. 8, and further illustrating diagrammatically the resulting metal grain structure as well as machining scores (exaggerated for illustration);

FIG. 17 is a perspective view of the air-frame splice fitting forged by the apparatus of FIGS. 1 thru 5, also illustrating in fragment and in phantom line two adjacent air-frame members to be joined thereby and showing pilot holes drilled through the walls of the splice fitting to aid in its installation;

FIGS. 18 and 19 are two elevations partly in section taken 90° apart in FIG. 17, and showing the splice fitting of FIG. 17 riveted to the adjacent air-frame members; and, FIG. 20 is a diagrammatic perspective view of four forging die segments externally configured as the frustrum of a four faced pyramid when converged, the die segments being shown in the open position, and also illustrating in perspective the wedge cavity as a mating pyramidal frustum in the press member which moves the die segments from the intermediate to the closed position.

DETAILED DESCRIPTION OF THE PREFERRED EMBODIMENT

Figure 1:
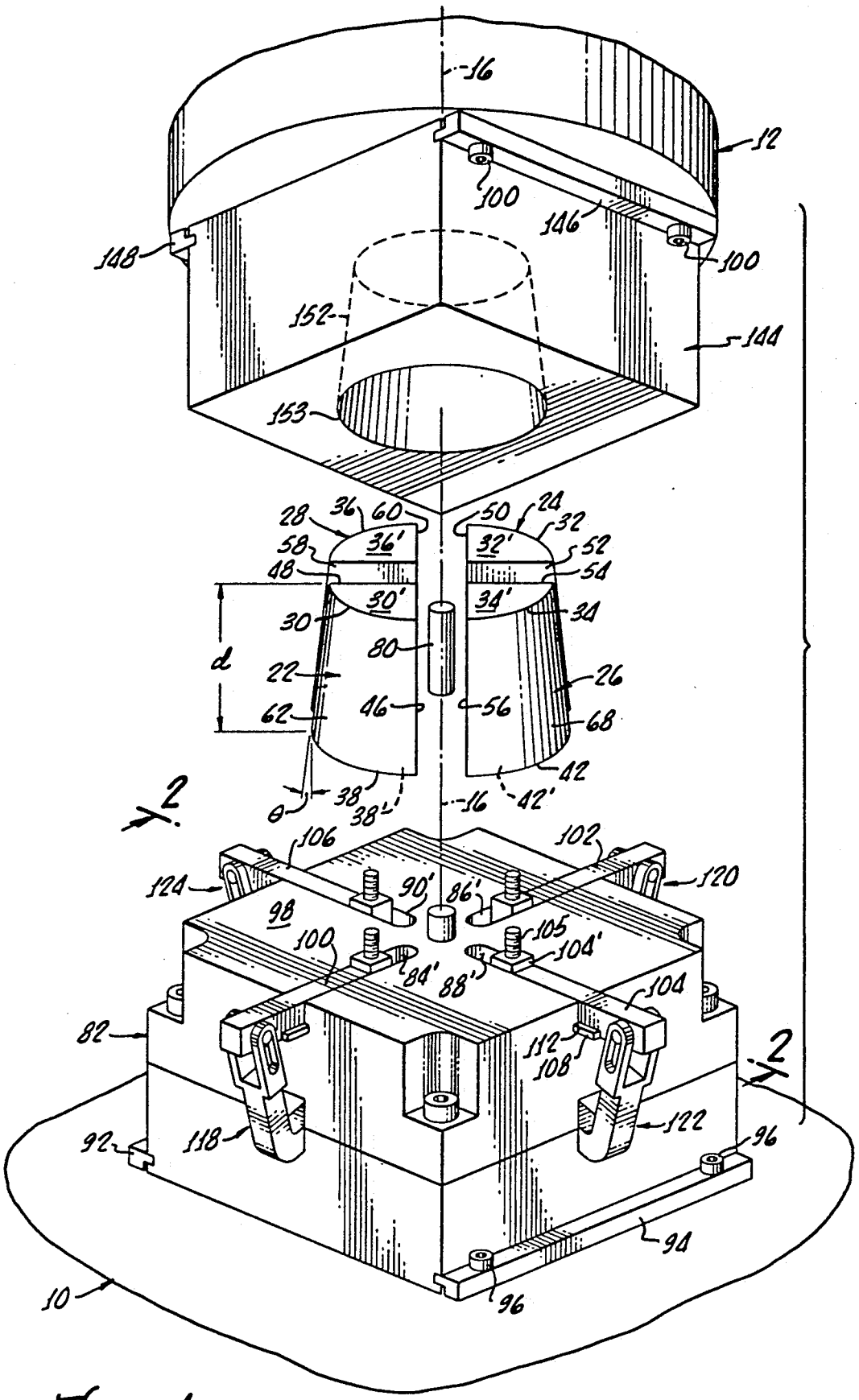
FIG. 1 is a perspective view, partially exploded, depicting the holder, forging die segments, billet and press member mounted between the base and moveable platens of a conventional forging press.

Referring now to FIGS. 1 thru 6, a conventional forging press has a base platen 10, an opposing moveable platen 12 and a double acting ram 14 for moving the moveable platen 12 along a central forging axis 16 toward and away from the base platen 10 to apply forging forces therebetween and to separate the platens 10, 12 for access therebetween. Gas fired burners 18, 20 supply heat as is conventional for a hot forging operation. Modified burners or other conventional heating means may be employed. So far as the present invention is concerned, the methods and apparatus for heating and temperature sensing are conventional and well known including those for pre-heating the billet in an oven or the like. The basic conventional requirement is that the billet be maintained at proper forging temperature during the forging process; that is, the forging dies must not prematurely cool the billet, hence they are maintained at substantially the same temperature. Forging temperatures are conventional and depend upon the metal alloy or metal matrix composite material being forged.

A plurality of four mating forging die segments 22, 24, 26, 28, respectively having tops 30, 32, 34, 36, bases 38, 40, 42, 44, proximal wall surfaces 46 and 48, 50 and 52, 54 and 56, 58 and 60, and respectively having exterior wall surfaces 62, 64, 68, 70, extending between said tops and bases, and with die cavities 72, 74, 76, 78 formed in the proximal surfaces, 50, 52, 56 and 58 of three of the die segments, 24, 26, 28, respectively, encompass 360° about the central forging axis 16, for a substantial length d of such central forging axis.

As can be seen by inspection in FIGS. 4 and 5, substantial portions of the proximal surfaces of the respective die segments abutt when the dies are converged on the central forging axis 16, and the die segment cavities in cooperation with other portions of the proximal surfaces of the die segments volumetrically confine a space in which a potential forging is very closely defined. Abutting cavities can be used if needed, but usually a cavity formed in the proximal surface of one die segment for abuttment with the proximal surface of the mating circumferentially adjacent die segment is sufficient and is preferred.

The forging die segments, 22, 24, 26, 28, surround an elongated metallic billet 80 in the form of a cylinder having a longitudinal axis positioned coincident with the central forging axis 16, hence designated by the same reference numeral 16 throughout the drawings.

The forging die segments 22, 24, 26, 28 have relatively large flat base surfaces 38', 40', 42' and 44', respectively, and relatively small flat top surfaces 30', 32', 34', 36', respectively, with the respective exterior wall surfaces 62, 64, 68, 70 of the die segments diverging outwardly from the central forging axis 16, going from top to base of each die segment. This divergence is at a shallow acute angle $\theta$ of between very near five degrees, and about eight degrees or slightly more. It should be noted that $\theta$ should substantially exceed three degrees to avoid binding of surfaces in the case of use of a conical or pyramidal wedge cavitity as below described.

As can be seen by inspection in FIGS. 1 thru 5, the plurality of die segments 22, 24, 26, 28 in the closed position (FIGS. 3 and 5) have an external configuration approximating that of the frustum of a right cone centered co-axially on the central forging axis, with the top of the frustum being defined collectively by the top surfaces 30', 32', 34', 36' of the die segments, the base of the frustum being defined collectively by the base surfaces 38', 40', 42', 44' of the die segments, and the convergent body of the frustum being defined collectively by the exposed exterior wall surfaces 62, 64, 68, 70 of the die segments.

The plurality of die segments 22, 24, 26, 28 are mounted on a holder 82 (FIGS. 1–3) for restricted movement toward and away from the central forging axis respectively along different radial paths, as illustrated by the arrows 84, 86, 89, 90 in FIGS. 4 and 5. These radial paths lie in a common plane disposed normal to the central forging axis 16, and the restricted movement is between the closed position as seen in FIGS. 3 and 5 and an open position as seen in FIGS. 2 and 4, where the die segments are separated and disposed at spaced apart radial positions about the central forging axis 16. An intermediate position where the die segments converge to first engage the billet is illustrated in phantom line in FIG. 4.

The holder 82 is a load bearing structure mounted to the base platen 10 of the forging press and centered on the central forging axis 16 by conventional clamp structures 92, 94 which can be tightened by machine screws 96.

The holder 82 has an exposed substantially flat supporting surface 98 disposed in a plane normal to the central forging axis 16. A plurality of elongated open slots 84', 86', 88', 90' are formed through the holder supporting surface 98, and respectively correspond in alignment and extent with the separate radial paths illustrated by the arrows 84, 86, 88, 90 in FIGS. 4 and 5 for the die segments 22, 24, 26, 28, respectively. The open slots each have an elongated arm 100, 102, 104, 106 mounted therein for sliding movement along the slot.

As is typical for all such elongated arms, elongated arm 104 which slides in the open slot 88' has at its inward end an upstanding rectangular boss 104' which protrudes above the supporting surface 98 of the holder and is received by a mating recess in the base of its corresponding die segment 26, and a machine screw 105 extends outwardly through the arm boss 104' and screws into the base of the corresponding die segment 26 to hold the die segment onto the boss, with the base surface 42' of the die segment in sliding engagement with the supporting surface 98 of the holder. Thus, as the elongated arm 104 slides back and forth in the slot 88', the corresponding die segment 26 is moved accordingly back and forth along its radial path 88, this structure and function being typical for all elongated arms and corresponding slots and die segments. As most clearly seen in FIG. 6, and tyPical of all elongated arms, corresponding slots and die segments, the elongated arm 104 has elongated keys 108, 110 running along opposite sides thereof, and engaged slidably in corresponding key ways 112, 114 formed in the side walls of the slot 88' in which it slides, thus locking the arm 104 in the slot 88', but for longitudinal sliding movement therein. The base surface 42' of the die segment 26 bridges across the open slot 88' in sliding engagement with the supporting surface 98 of the holder 10.

The outer ends of the respective elongated arms 100, 102, 104, 106 are engaged by mechanical linkages 118, 120, 122, 124, respectively, for sliding the arms back and forth in the slots.

As best seen in FIGS. 2 and 3, for the mechanical linkages 122, 124, and typical for all the linkages, each linkage 122, 124 is pivotally mounted to the holder 82 by a pivot pin 128, 130 and is spring loaded by an adjustable compression spring and plunger mechanism 132, 134 to move the associated arm 104, 106 toward the central forging axis 16.

A double acting ram 136 is mounted to the base platen 10 beneath the holder 82, and acts through an opening 138 in the holder 82 and base platen 10 to engage the mechanical linkages 122, 126 to pivot the about their pivot pins 128, 130 against the force of the compression spring and plunger mechanisms 132, 134 so as to move the corresponding arms 104, 106 outwardly in the slots, so as to move the die segments to the open position illustrated in FIGS. 2 and 4. The ram 136 is centered on the central forging axis and has a central ramming member 140 which engages a free floating plunger 142 which in turn simultaneously engages all the mechanical linkages, to move the four die segments to the open position. The ram retracts its ramming member 140 to the position shown in FIG. 3, to progressively leave the mechanical linkages subject to the spring loads, thus simultaneously moving the four die segments toward the closed position.

A press member 144 is mounted on the moveable platen 12 of the forging press by clamp mechanisms 146, 148 secured with machine screws 150, and is centered on the central forging axis 16. The press member has open cavity 152 configured as the frustum of a cone, disposed coaxial with the central forging axis 16 and matching the frustum configuration of the die segments in their closed position. The larger base end 153 of the frustum cavity is open.

At the center of the supporting surface 98 of the holder 10 is an upstanding cylindrical pedestal 154 accommodated by corresponding cavities in the proximal surfaces of the die segments at their base, so that there is no interference with closing the dies. The cylindrical pedestal 154 is disposed co-axial with the central forging axis 16 and serves to help locate and support the billet 80 in proper position prior to engagement of the billet by the die segments.

Referring to FIGS. 1–5, the forging procedure is as follows: The primary ram 14 of the forging press is activated to move the moveable platen 12, hence the press member 144 away from the lower platen 10 and holder 82 to provide access. The lower ram 136 is then actuated to pivot the mechanical linkages about their pivot axes to slide the respective arms 100, 102, 104, 106 outwardly along their respective slots to move the corresponding die segments 22, 24, 26, 28 to the open position as illustrated in FIGS. 2 and 4.

Any previously forged structural member is then manually removed, and a conventional lubricant is then applied to the hot forging die segments. Such lubricant, for example, can be a dispersion of graphite in a light oil. When applied, the oil flashes burns) leaving the graphite and combustion products as a lubricant on the forging die surfaces.

A preheated billet 80 is then manually inserted onto the pedestal 154 coaxially with the central forging axis 16, in proper position surrounded by the forging die segments. The lower ram 136 is then reversed to retract its ramming member 140 allowing the mechanical linkages to pivot about their pivot axes under the influence of the respective compression spring/plunger mechanisms to the intermediate position (illustrated in phantom line in FIG. 4) where the respective forging die segments simultaneously engage the billet. In this intermediate position, the tops of the forging die segments which are slightly spread apart by the interposed billet 80 nevertheless are sufficiently close together to fit within the confines of the base opening 153 of the frustum cavity 152 in the press member 144. At this point, the principal forging press ram 14 is activated to force the press member 144 onto the forging die segments from their top to base so as to wedge them from the intermediate to the closed position. This is a smooth and compound action and applies a forging force radially convergent on the billet, in a gradual smooth programmed manner which aids in allowing the billet material to properly flow to fill the die segment cavities with the desired metal grain structure resulting.

Once the minor flashings are removed, the resulting forged structural member 156 is that shown in FIGS. 17–19.

The use of a convergent geometric solid figure such as the cone 152 symmetrical about the central forging axis 16 as a matching frustum cavity for closing the dies to the closed position while applying forging forces thereto has considerable advantages. The mating frustum cavity completely surrounds and captures the forging die segments causing them to come together smoothly and simultaneously, and is a very forgiving structure in terms of such force and guidance. Moreover, the use of a cylindrical billet is advantageous. While it is possible to use billets which are somewhat pre-formed considering the variation in their ultimate forged configuration along the axis 16, the cylindrical billet, which is quite amenable to the present apparatus and process, is not sensitive to its initial angular orientation about its own axis, thus simplifying the forging operation.

On the other hand, the use of the matching frustum cavity 152 in the pres member 144 does pose certain limitations. Thus, the cylindrical billet 80 must not be so large in diameter as to spread the forging die segments too far apart in the intermediate Position because the base opening 153 of the frustum cavity 152 must be able to fit over the slightly spread apart tops of the forging die segments in order to properly engage their exterior surfaces, as opposed to impacting the top surfaces of the forging die segments. This in turn is dictated somewhat by the angle $\theta$. The larger the angle 8, the greater the degree to which the forging die segments may be spread apart in the intermediate position. An angle $\theta$ in excess of 10 degrees is not recommended, and might create other problems. On the other hand, an angle substantially less than 5 degrees, for example 4 degrees, and most certainly an angle of 3 degrees, would cause difficulty with binding of the press member cavity with the forging die segments in the closed position, making it difficult to remove the press member 144 from the die segments in the closed position.

As has been mentioned, the resulting metal grain structure from the forging process should be optimized for strength and durability of forged structural members which perform critical structural functions.

Referring now to FIGS. 7–10, FIG. 7 illustrates the cylindrical metallic billet 80 diagrammatically, showing elongated metal grain structure running approximately parallel to the axis 16 of the billet.

FIG. 8 illustrates the resulting metal grain structure in a cruciform section of a structural member forged by the process of the invention showing that the metal grain structure in the respective walls 158, 160, 161, 162 of the structure runs about parallel to the outward extent of the walls from the axis 16, as opposed to transversely to their thickness, thus representing a strong and dependable structure. Tensile forces on any wall are resisted by longitudinal stresses along grain boundaries.

On the other hand, as illustrated in FIG. 9, the typical forging process of the prior art to accomplish a similar cruciform structure would involve two forging dies 164, 168 along a forging axis 166 in which corresponding walls 158', 162' would necessarily have a very large draft and be unnecessarily massive especially at the base of the walls, all in accordance with conventional forging practices in order to properly fill the die cavities forming the walls 158', 162' and subsequently to remove them from the die cavities. Also to accomplish this requires a starting billet considerably larger than needed to fill the prior art die cavities and results in a considerable waste of material as excess flashing 170, 172 through the gutter areas of the dies 164, 168.

Most significantly, as illustrated by phantom line in FIG. 10, in order to conform the resulting forged structure of the prior art to the required dimensional specifications (shown in FIG. 8), much excess material must be removed by a subsequent machining operation. This is not only an expensive extra step in producing the resulting structural member according to dimensional specifications, but also as can be seen seriously interrupts the forged metal grain structure leaving the machined walls 158', 162' with principal metal grain structure running transverse along the thickness of the walls as opposed to parallel along their extent. Also, such machining process leaves very minute, but significant, cutter tool gouges or marks (highly exaggerated in FIG. 10 at 174). The result is that tensile forces on the machined walls 160', 162' are resisted by transverse stresses between relatively short metal grain boundaries, thus substantially weakening the forged structure, such weakness being enhanced by the stress focal points created by the score lines or gouges 174 of the machine cutting tools used in the machining process. This can be a hidden defect in such structural members and can result in premature and catastrophic failure from what might otherwise be expected as structural strength of such members.

The resulting forged structural member 156, illustrated in FIGS. 17–19, as well as the forging process and resulting forged members illustrated in FIGS. 11–16, all represent various forms of splice fittings as used in the aircraft industry for joining air-frame members. As can be seen by inspection, all of these members have walls of substantial extent extending along and respectively outward in different directions from the axis 16, and this outward extent is for a distance many times the average thickness for each wall.

In accordance with the present apparatus and process, these splice fittings are forged from lightweight metal alloys or lightweight metal matrix composite materials, thus representing the material illustrated for the cylindrical billet 80 in FIG. 7, as an example of the present invention.

There are many lightweight metal alloys used in the aircraft industry; for example, splice fittings typically use 7050 or 7075, T6 or T73 aluminum alloy, or sometimes titanium alloys. As used herein, "lightweight metal alloys" means lightweight relative to steel, such as aluminum, titanium, magnesium and berylium alloys or to the so-called "space age" versions thereof for example such metals as combined with lithium. Also included are lightweight metal matrix composites which refers to fibrous composites with the same mentioned lightweight metals, for example, so-called silicon- carbide whiskered aluminum or magnesium.

Referring now to FIGS. 17–19, the forged structural member 156 resulting from the apparatus and method of FIGS. 1–5 is a splice fitting for use in aircraft or the like to interconnect structural frame members. This splice fitting 156 has two major walls 176, 177 of substantial area disposed approximately in two separate planes which intersect approximately on the original billet axis 16 at right angles to one another. Each wall is of substantial extent and has the metal grain structure essentially as illustrated in FIG. 8 where the principal metal grain runs outwardly from the axis 16 and approximately parallel to the extent of the walls 176, 177, as opposed to transversely thereto along their thickness.

In FIG. 17, the wall 176, which essentially is bisected by the wall 177, has a pair of pilot holes 178, 179 drilled in it. The other wall 177 has a pair of pilot holes 180, 181 drilled in it. These pilot holes are an aid to the structural assembly operation in aircraft manufacturing whereby two adjacent air frame members 182, 183 are to be joined by the splice fitting 156, ultimately as shown in FIGS. 18 and 19.

In FIGS. 18 and 19 the pilot holes 178, 179, 180, 181 have been used as an aid to create proper holes not only through the walls of the splice fitting 156 but as well through the air frame members 182, 183 to be joined. The joining takes place by riveting, two rivets 184, 185 joining the wall 176 of the splice fitting 156 with the air frame member 183, and two other rivets 186, 187 joining the other wall 177 of the splice fitting with the air frame member 182.

Figure 11:
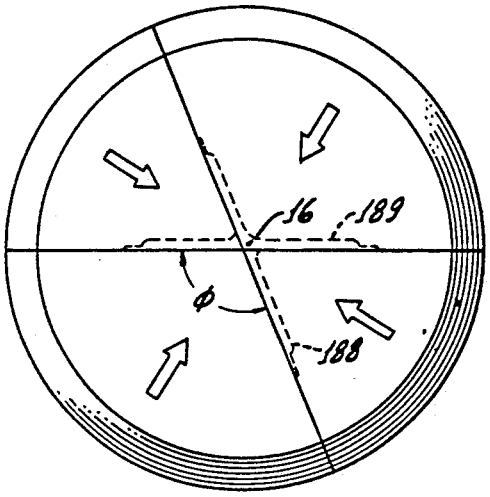
FIG. 11 is a top diagramatic view of four forging die segments in the closed position, according to the present invention, illustrating the forging of a structural member, a form of splice fitting, having walls which reside approximately in planes that intersect at other than right angles along the billet axis.
Figure 12:
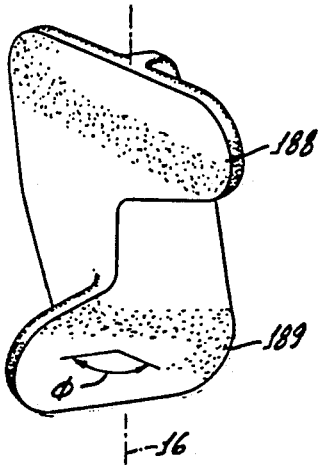
FIG. 12 is a perspective view of the structural member forged by the dies of FIG. 11.

Referring now to FIGS. 11–16, FIG. 11 illustrates four mating die segments in the closed position, and having an external cone frustum configuration viewed from the top, as employed to forge the splice fitting illustrated in FIG. 12. The splice fitting of FIG. 12 is somewhat similiar to that shown in FIG. 17 but for the fact that the walls 188, 189 of the splice fitting of FIG. 12 lie in separate planes which do not intersect at right angles, as indicated by the angle $\phi$ of approximately 110 degrees.

Figure 13:
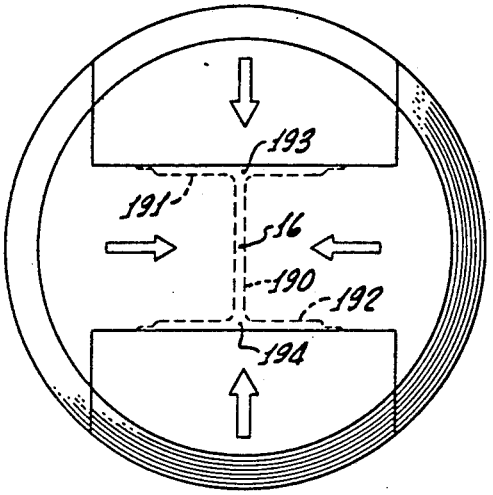
FIG. 13 is a top diagrammatic view of four forging die segments in the closed position according to the present invention illustrating the forging of a channel shaped air-frame splice fitting.
Figure 14:
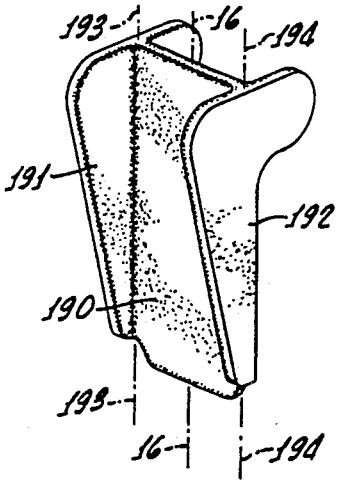
FIG. 14 is a perspective view of the splice fitting forged by the the segments of FIG. 13.

FIG. 13 illustrates a conical frustum of four die segments to forge a channel shaped splice fitting as illustrated in FIG. 14 in which there are three walls 190, 191, 192 disposed in planes intersecting at right angles, with the walls 191, 192 intersecting with the wall 190 along axes 193, 194 disposed approximately parallel to the original billet axis 16.

Figure 15:
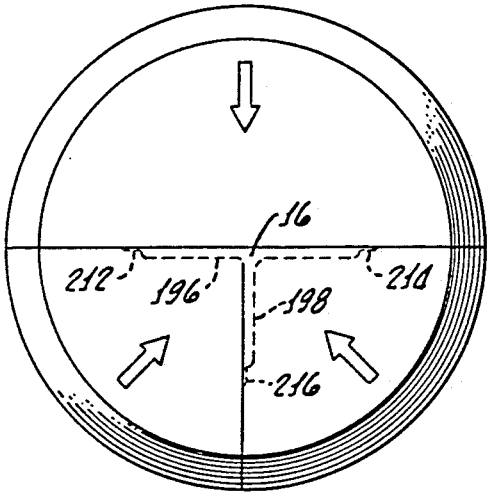
FIG. 15 is a top diagramatic view of three forging die segments radially converged to the closed position in accordance with the present invention, illustrating the forging of a T-shaped air-frame splice fitting.
Figure 16:
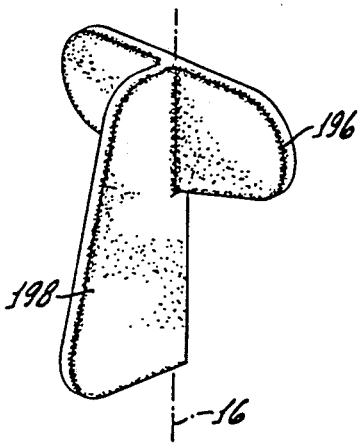
FIG. 16 is a perspective view of the T-shaped splice fitting forged by the die segments of FIG. 15.

FIG. 15 illustrates the use of three forging die segments configured as the frustum of a cone as viewed from the top and illustrating the forging of the T-shaped splice fitting shown in FIG. 16 have a first wall 196 disposed at right angle to a second wall 198, the walls 196, 198 being disposed in planes which intersect along a line approximately coincident with the original billet axis 16.

In all the splice fittings illustrated respectively in FIGS. 12, 14 and 16 the metal grain structure runs outwardly from the axis 16 and approximately parallel to the extent of the walls as opposed to transversely thereto along the thickness thereof, consistent with the diagramatic illustration in FIG. 8, as a result of the present forging method.

Referring now to FIG. 20, as an alternative to the use of a cone as a convergent geometric solid symetric about the central forging axis, it may be at times advantageous to use instead a pyramidal configuration both for the external configuration of the plurality of forging die segments, as well as for the frustum cavity in the press member. Accordingly, a pyramidal configuration of the wedge cavity 200 in the press member 202 is shown, and correspondingly four mating die segments having substantially flat exterior surfaces 204, 206, 208, 210 are shown in the open position about the cylindrical billet 80, and forging axis 16 all in exploded perspective. This configuration can give extra guidance to the respective forging die segments in regard to any tendency that they might otherwise exhibit to rotate to a very slight degree when converging upon a billet.

While not very well illustrated, the die cavities of FIGS. 1–5, as well as those illustrated in FIGS. 11, 13, and 15 have minor cavity extensions for accommodating excess material from the billet as a minor flashing, which is later removed from the forged structural member after forging. In FIG. 15, for example, typical cavity extensions for flashing are illustrated at 212, 214 and 216. In FIG. 8, such flashing is illustrated at **158*a*, 160*a*, 161*a* and 162*a*. Corresponding minor flashing cavities can be seen from inspection of FIGS. 4 and 5 and, for example in FIGS. 11, 13, 15**. These minor flashing cavity extensions are conventional in forging. The present apparatus and method permits close control of the amount of metal in the original billet to conform very closely to the cavities which define the volume of the resulting forged structure.

I claim:

1. In a metal forging apparatus for receiving a preheated elongated billet formed of lightweight metal alloy or lightweight metal matrix composite material disposed along a longitudinal billet axis, and hot forging said elongated billet into an integral high strength structural member having at least two walls extending along and respectively outward in different directions from said longitudinal billet axis, each wall having a substantial area and an average thickness, and extending outwardly from said longitudinal billet axis for a distance many times said average thickness, the improvement which comprises:

(a) a plurality of at least three mating solid forging die segments having tops, and bases, and having extensive proximal and exposed exterior wall surfaces which intersect and extend between said tops and bases, with die cavities formed in proximal surfaces of at least two of said forging die segments, said forging die segments being shaped to radially converge together into a closed position about a central forging axis while together encompassing 360° about said central forging axis for a substantial length of said central forging axis, in which closed position proximal surfaces of circumferentially adjacent die segments are in mating engagement with said die cavities and portions of said proximal surfaces of the die segments volumetrically defining said structural member to be forged;

(b) each forging die segments having a relatively large and substantially flat base surface lying approximately in a plane normal to said central forging axis, and a relatively small top surface, with said exterior wall surface thereof diverging outwardly at a shallow acute angle with respect to the central forging axis going from top to base of the die segment;

(c) said plurality of die segments in the closed position having an external configuration approximating that of the frustum of a right cone or pyramid disposed coaxially on said central forging axis, with the base of the frustom being defined collectively by the base surfaces of the die segments, the top of the frustom being defined collectively by the top surfaces of the die segments and the convergent body of the frustom being defined collectively by said exterior wall surfaces of the die segments;

(d) means mounting said forging die segments about said central forging axis for restricted movement toward and away from said central forging axis each along a different one of at least three different approximately radial paths, said paths extending generally radially from said central forging axis in a common plane normal to said central forging axis, and said movement being between said closed position and an open position, in which open position said forging die segments are separated and disposed at spaced apart radial positions about said central forging axis;

(e) means for moving said forging die segments to said open position to enable the removal of any previously forged structural member, and the introduction and disposition of said heated elongated billet with its longitudinal axis approximately coincident with said central forging axis in readiness to forge said structural member to be forged;

(f) means for heating the forging die segments to the approximate forging temperature of said billet material;

(g) means for moving said heated forging die segments toward the closed position to an intermediate position to initially engage said elongated billet disposed co-axial along said central forging axis;

(h) a press member for moving the heated forging die segments from the intermediate to the closed position while applying forging forces thereto, said press member defining an open cavity configured to match the frustum configuration of the plurality of forging die segments in the closed position, said frustrum cavity being disposed coaxially with said central forging axis; and, (i) forging press means for producing relative movement between the press member and the forging die segments for at least the full extent thereof along the central forging axis so as to engage and disengage the frustum cavity of the press member with the forging die segments, whereby in such engagement said frustum cavity first envelope the stops of the forging die segments in their intermediate position and continues to envelop the bases of the forging die segments while gradually forcing the forging die segments to their closed position, and wereby the frustum cavity of the press member may be disengaged from the forging die segments to permit their outward movement to the full open position for removal of the forged structural member.

2. The apparatus of claim 1, wherein the elongated metallic billet is approximately cylindrical.

3. The apparatus of claim 2, wherein the elongated metallic billet is of aluminum or titanium alloy, with principal metal grain structure running approximately parallel to the longitudinal billet axis.

4. The apparatus of claim 1, wherein said divergence of the exterior wall surfaces of the forging die segments with respect to the central forging axis is at a shallow acute angle of between at least five degrees and about eight degrees.

5. The apparatus of claim 1, wherein:

(a) the forging press means has a base platen, an opposing movable platen, and a double acting ram means for moving the moveable platen along said central forging axis toward and away from the base platen to apply forging forces therebetween and to separate said platens for access therebetween;

(b) the press member is mounted for said movable platen, (c) the means mounting the forging die segments for restricted movement along said approximately radial paths comprises a holder, and means mounting said holder to the base platen of the forging pressure in a position centered on said central forging axis; and, (d) the holder comprises a load bearing structure having an exposed substantially flat supporting surface disposed approximately in a plane normal to said central forging axis, with a plurality of open slots formed therein, said open slots being aligned and co-extensive with said approximately radial paths about said central forging axis; a movable arm disposed in each of said slots; means connecting each such arm to the base of a respective one of the forging die segments with the base surface of the forging die segment bridging the slot containing the arm and being in sliding engagement with said substantially flat supporting surface of the holder, and means coupled to said movable arms for moving said forging die segments to said open and intermediate positions.

6. In a method for close tolerance hot forging an elongated metallic billet, formed of lightweight metal alloy or lightweight metal matrix composite material and having a longitudinal axis with principal metal grain structure running approximately parallel to said longitudinal axis, into an integral high strength structural member having at least two approximately flat walls of substantially uniform thickness extending along and respectively outward in different directions from said longitudinal billet axis, each wall having a substantial area and extending outward from said longitudinal billet axis for a distance many times such wall thickness, the improvement which comprises the steps of:

(a) heating said elongated billet to the forging temperature of its material;

(b) supporting said heated elongated billet in a position with its longitudinal axis disposed approximately co-axial with a central forging axis;

(c) said position being surrounded by a plurality of at least three mating forging die segments having extensive proximal surfaces, with die cavities formed in proximal surfaces of at least two of said forging die segments, said forging die segments being shaped to radially converge together into a closed position about said central forging axis while together encompassing 360° about said central forging axis for a substantial length of said central forging axis, in which closed position proximal surfaces of circumferentially adjacent die segments are in operative mating engagement, with said die cavities and portions of said proximal surfaces of the die segments volumetrically defining said structural member to be forged;

(d) heating the forging die segments to the approximate forging temperature of the billet material;

(e) gradually moving said heated forging die segments simultaneously along different approximately radial paths toward the central forging axis to the closed position so as to hot forge said billet into said structural member to be forged and so as to achieve a principal metal grain structure running approximately parallel to the outward extent of said walls; and (f) moving said forging die segments outward from said central forging axis along said approximately radial paths to an open position for removal of the hot forged structural member.

* * * * *